US005802752A

United States Patent [19]

Quarfordt

[11] Patent Number: 5,802,752

[45] Date of Patent: Sep. 8, 1998

[54] TOOTH ARRANGEMENT FOR EXCAVATOR

[75] Inventor: Per Ulf Torgny Quarfordt, Karlskoga, Sweden

[73] Assignee: Componenta Wear Parts AB, Kristinehamn, Sweden

[21] Appl. No.: 702,704

[22] PCT Filed: Mar. 2, 1995

[86] PCT No.: PCT/SE95/00218

§ 371 Date: Sep. 16, 1996

§ 102(e) Date: Sep. 16, 1996

[87] PCT Pub. No.: WO95/25851

PCT Pub. Date: Sep. 28, 1995

[30] Foreign Application Priority Data

Mar. 21, 1994 [SE] Sweden ..... 9400934

[51] Int. Cl.[6] ..... E02F 9/28

[52] U.S. Cl. ..... 37/452; 37/457

[58] Field of Search ..... 37/457, 447–456; 172/753; 411/512; 403/379, 318

[56] References Cited

U.S. PATENT DOCUMENTS

| | | | |
|---|---|---|---|
| 1,234,114 | 7/1917 | Andrews | 37/454 |
| 1,384,701 | 7/1921 | McMonegal | 37/454 |
| 1,718,268 | 6/1929 | Wikstrom | 37/454 |
| 1,799,929 | 4/1931 | Rauch | 37/454 |
| 1,805,527 | 5/1931 | Van Cortright Mekeel | 37/454 |
| 2,904,908 | 9/1959 | Ratkowski | 37/458 X |
| 2,951,300 | 9/1960 | Ratkowski | 37/457 |
| 3,388,488 | 6/1968 | Duplessis | 37/452 X |
| 3,520,224 | 7/1970 | Hensley et al. | 37/457 X |
| 3,526,049 | 9/1970 | Nichols | 37/457 |
| 3,526,435 | 9/1970 | Krekeler | 37/457 X |
| 3,621,594 | 11/1971 | Hahn et al. | 37/453 X |
| 4,192,089 | 3/1980 | Schwappach | 37/457 |
| 4,231,173 | 11/1980 | Davis | 37/457 |
| 4,823,487 | 4/1989 | Robinson | 37/457 |
| 5,068,986 | 12/1991 | Jones | 37/457 |
| 5,075,986 | 12/1991 | Smith et al. | 37/457 |
| 5,331,754 | 7/1994 | Ruvang | 37/457 |
| 5,469,648 | 11/1995 | Jones et al. | 37/457 |
| 5,561,925 | 10/1996 | Livesay | 37/457 X |

FOREIGN PATENT DOCUMENTS

| | | |
|---|---|---|
| 0531603 A1 | 3/1993 | European Pat. Off. . |
| 2748206 A | 5/1978 | Germany . |

*Primary Examiner*—Terry Lee Melius
*Assistant Examiner*—Victor Batson
*Attorney, Agent, or Firm*—Dennison, Meserole, Pollack & Scheiner

[57] ABSTRACT

An excavation tooth arrangement including a point adapter, a holder and a dowel. The ends of the point adapter and of the holder have male and female parts which are configured to be joined and held together by insertion of a dowel into a groove which includes a pocket. The dowel includes a part which snaps into this pocket and thus remains in a desired position.

9 Claims, 4 Drawing Sheets

TOOTH ARRANGEMENT FOR EXCAVATOR

BACKGROUND OF THE INVENTION

The present invention relates to a tooth arrangement, preferably for use with machines for earth working. Such machines are generally provided with an excavator bucket having a cutting edge and thereon a number of holders, each provided with a tooth. In such an excavator the teeth are intended to loosen a ground surface which the cutting edge then transfers to the actual bucket space. The cutting edge of an excavator generally consists of a separate plate welded to the actual bucket, a number of holders being attached to the cutter. The holders are intended to receive a point adapter that is secured to the holder with the aid of a dowel. The free end of the point adapter is in turn provided with an arrangement for securing a point. A point adapter is attached to a holder by means of a turning movement followed by a displacement movement. This is a laborious procedure and also entails the drawback that the parts of the holder and point adapter that are to cooperate with each other are dimensioned too slim from the strength point of view.

OBJECT OF THE INVENTION

The object of the present invention is to facilitate joining holder and point adapter together. According to the invention this is achieved with only a linear displacement movement, after which the two parts are locked together by means of a dowel. This procedure enables the cooperating parts of holder and point adapter to be made more robust, thereby resulting in greater strength. From a purely practical point of view the opposite ends of the holder and the point adapter each have a male part and a female part located one above the other, the male part of the holder being located opposite to a female part of the point adapter and a male part of the point adapter being located opposite to the female part of the holder. One male part is provided with a longitudinal ridge intended to cooperate with a longitudinal groove in the other male part. The two male parts are each provided with a transverse groove, said grooves providing a transverse cavity for a dowel in order to lock the joined holder and point adapter together.

SUMMARY OF THE INVENTION

According to a preferred embodiment the transverse cavity for a dowel has a predetermined cross section so that if a dowel with the same cross section is inserted into said cavity, the dowel will always assume a predetermined position.

According to a preferred embodiment the dowel may be arc-shaped and be so oriented in the cavity for the dowel that the plane of the dowel will coincide substantially with the axial plane of the holder and the point adapter.

The wall of the groove in the ridge-like part of one of the male parts may be so designed that the cavity formed when the parts are fitted together, acquires one or two pockets that can be used for snap-in members pertaining to the dowel used.

According to a preferred embodiment of the present invention the dowel is in the form of a frame with two longitudinal sides, the space between the sides being filled with a yielding material such as rubber. One longitudinal side of the dowel is suitably free from the rest of the frame, and can thus be displaced inwardly. The other longitudinal side of the frame is provided with a protrusion to limit the inward movement of the movable side.

The longitudinal side of the dowel frame that is not movable may be provided externally with a snap arrangement to be snapped into the pocket that is formed by a transverse cavity, in the wall of the groove of one of the male parts.

However, it should be evident that the dowel arrangement described for joining the parts is not limited to use with a holder and a point adapter. Other uses for it are also possible where two optional parts are to be joined in which a groove is formed that has a pocket.

DETAILED DESCRIPTION OF THE INVENTION

Figure 1:
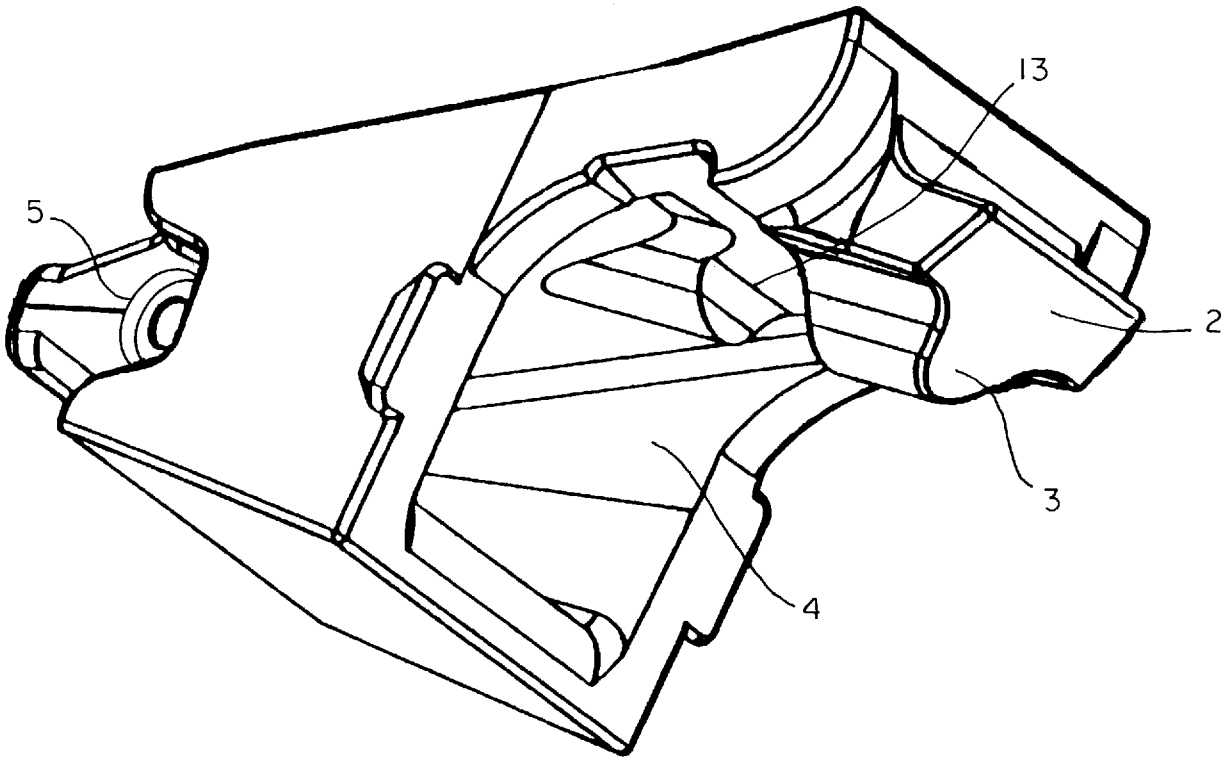
FIG. 1 shows a point adapter.
Figure 2:
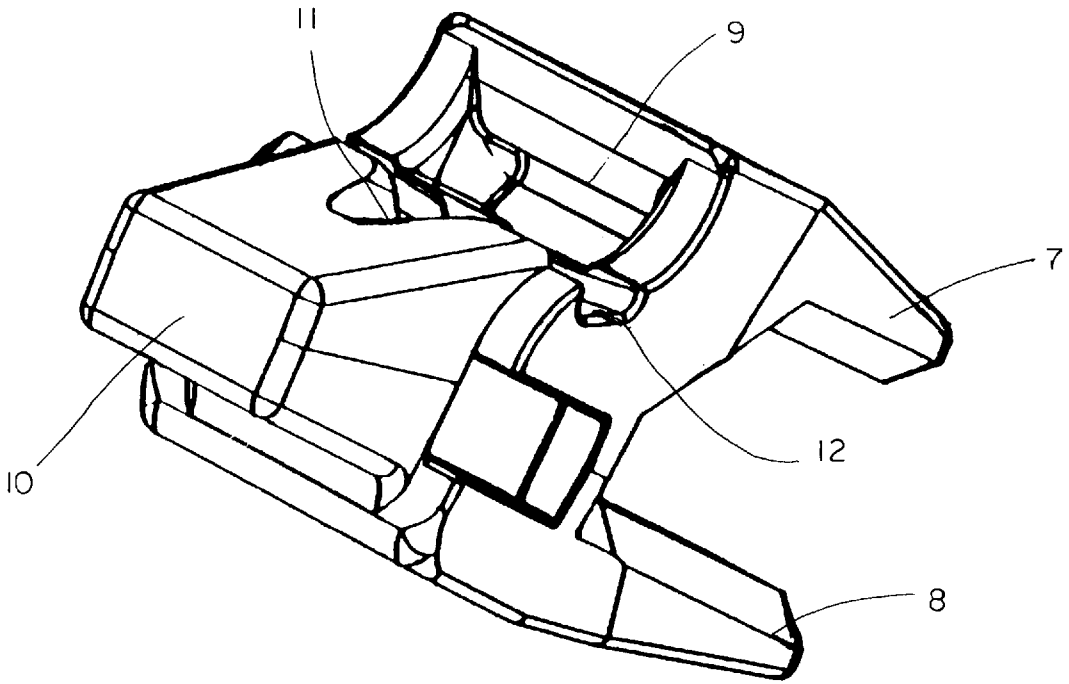
FIG. 2 shows a holder

In the figures, 1 is a point adapter provided with a male part 2. The male part is provided with a longitudinal ridge 3 and a female part 4 is arranged below the male part to receive a male part 10 from a holder 6, shown in FIG. 2. The male part 2 is formed as a longitudinal ridge 3 which is provided with a transverse groove 13 forming a pocket. The point adapter is provided at its left end with an attachment 5 for attachment of a point.

The point adapter 1 is designed to be inserted in the left end of a holder 6. The holder has two arms 7 and 8 to be used for welding to the cutting edge which in turn is welded to the front end, at the base of an excavator. The holder 6 is provided with a female part 9 for insertion of the male part 2 with ridge 3. The male part 10 of the holder is provided with an axial recess 11 for the ridge 3, as well as a transverse groove 12.

Since the holder 6 is welded to a cutter, the male part 2 of the point adapter must be pushed directly into the female part 9, whereupon the male part 10 penetrates into the female part 4 of the point adapter. When the holder 6 and point adapter 1 are fitted together the grooves 12 and 13 form a transverse cavity that is provided with smooth walls running all the way through. Alternatively the walls of the grooves 12, 13 may be designed so that one or two pockets appear in the cavity formed by the two grooves 12 and 13. A dowel can then be inserted if this dowel is provided with snap-in members they will snap into the pockets so that the dowel is locked in position.

The two grooves 12 and 13, together forming a transverse cavity, are shaped so that a predetermined cross section is obtained for the through-hole, which means that the dowel to be inserted in the cavity can only be inserted if it has a cross section corresponding to that of the cavity. The dowel will then always have a predetermined orientation in the cavity and if it is provided with a snap in arrangement, the arrangement will be located exactly aligned with a pocket.

Figure 3:
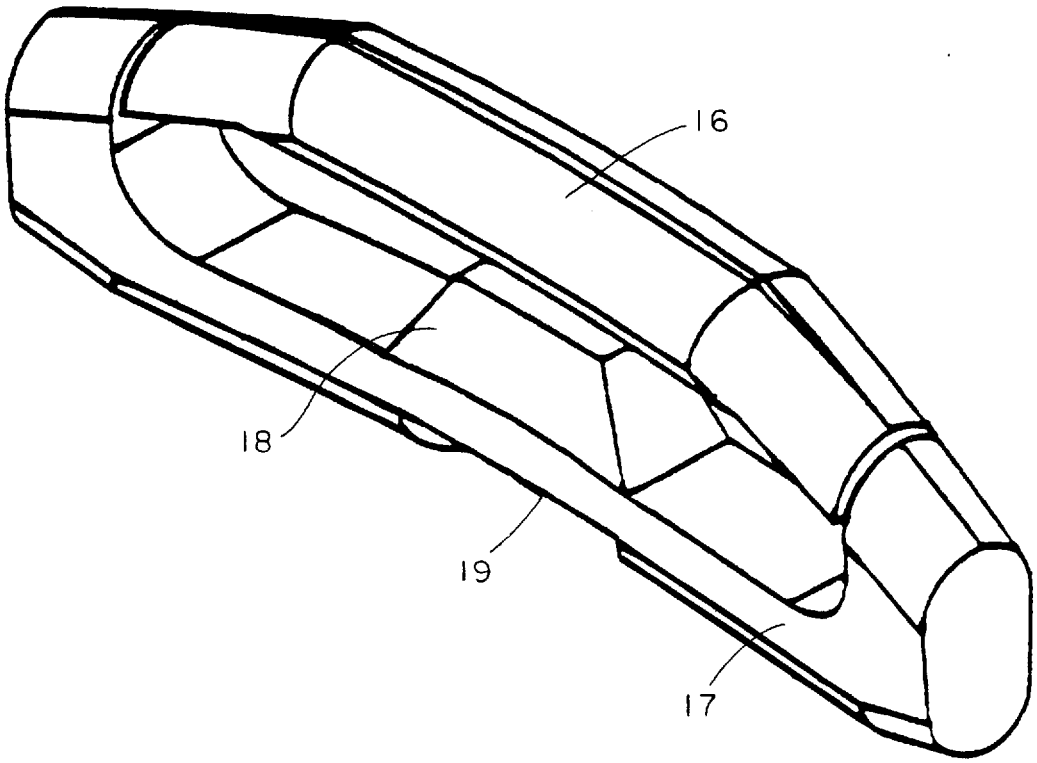
FIG. 3 shows the frame of a key.
Figure 4:
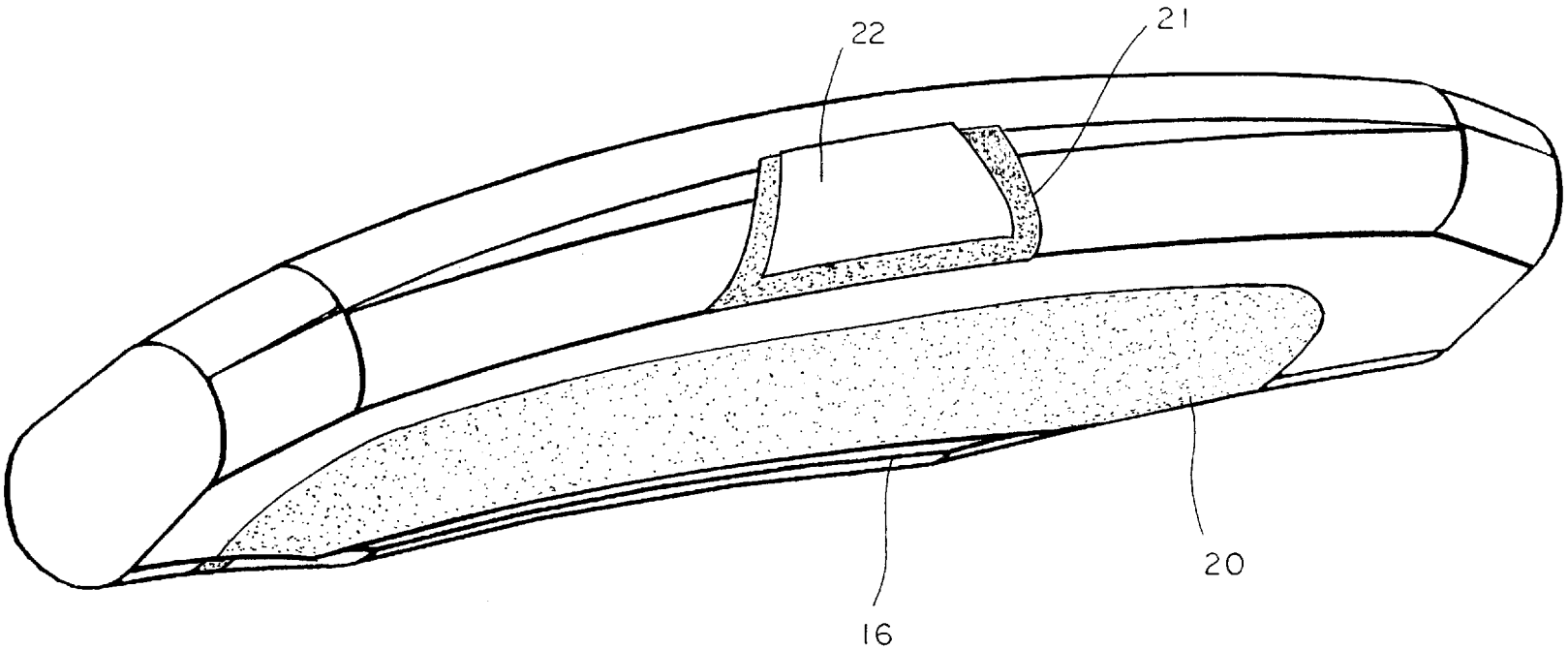
FIG. 4 shows a complete key.

It has proved suitable to manufacture a dowel as shown in FIG. 3, formed by a frame of homogenous material, slightly curved. The frame has been designated 15 and consists of a movable, longitudinal part 16 and a stationary remaining part 17. The part 17 of the frame is provided with a protrusion 18 intended to limit inward movement of the movable part 16. The part 17 has an external area intended for a snap arrangement. The space between the frame parts is filled with rubber, as shown in FIG. 4 where the rubber filling is designated 20. The movable part 16 of the frame can also be seen in the drawing. Furthermore it can be seen that the space 19 for a snap arrangement is filled with rubber 21, the upper side of this being covered with a metal plate 22. When the dowel is inserted into the transverse cavity formed by grooves 13 and 12, the metal plate 22 will be pressed by the rubber 21 which is formed into the pocket inside the cavity.

I claim:

1. A tooth arrangement applied on the cutting edge of an excavator bucket, said tooth arrangement having opposite ends removably joined together, a first end including a male part and a second end including a female part, the ends being locked together by a dowel going through the male part and the female part, wherein the first end further includes a female part, the second end further includes a male part, the female and male parts arranged one above the other, at least one male part including a longitudinal ridge which cooperates with a longitudinal recess in the other male part so that when the ends are joined together, they constitute a transverse groove for insertion of the dowel.

2. A tooth arrangement according to claim 1, wherein the transverse groove has a predetermined cross section configured for a dowel with a corresponding cross section so that the dowel has a predetermined orientation when inserted in the transverse groove.

3. A tooth arrangement according to claim 1, wherein one male part is ridged, a wall of the transverse groove of the ridged male part is provided with a recess so that when the ends are fitted together, a pocket appears in the transverse groove capable of retaining the dowel in a snap-fit.

4. A tooth arrangement according to claim 3, wherein the dowel is formed by an oblong frame surrounding a yielding material.

5. A tooth arrangement according to claim 4, wherein a first longitudinal side of the frame is separated from the rest of the frame.

6. A tooth arrangement according to claim 5, wherein a second longitudinal side of the frame is provided with an inwardly directed protrusion to limit the inward movement of said first longitudinal side of the frame.

7. A tooth arrangement according to claim 6, wherein said second longitudinal frame side is provided externally with an outwardly directed arrangement capable of engaging the transverse groove in a snap-fit.

8. An excavation tooth arrangement comprising:

a point adapter having an upper male part with a ridge extending in a first longitudinal direction and a female portion extending in a second, opposite longitudinal direction, said ridge including a first groove in a transverse direction;

a holder having two arms extending in a first direction, a female portion for insertion of the point adapter male part, a male part including a recess configured to conform to the ridge of the point adapter, a second groove in a transverse direction; and a dowel formed of a two portion frame and including means to hold the dowel in an inserted position when the point adapter is joined to the holder.

9. The excavation tooth arrangement according to claim 8, wherein the dowel includes a first portion frame made of slightly curved homogenous material, a second portion frame being movable with respect to the first portion frame which is further provided with a protrusion which limits movement of the second frame portion;

and wherein said means to hold the dowel in inserted position includes an external area in the second frame portion, a rubber inserted in the first portion frame protrusion and a metal plate cover; said cover being pressed by the rubber into a pocket which is formed by cavities in said first groove and said second groove.

* * * * *